United States Patent [19]

Barna

[11] 4,078,502

[45] Mar. 14, 1978

[54] FURNITURE CONSTRUCTION

[76] Inventor: Ivan J. Barna, 4186 Colony Rd., South Euclid, Ohio 44121

[21] Appl. No.: 653,370

[22] Filed: Jan. 29, 1976

[51] Int. Cl.[2] ..... A47B 13/02

[52] U.S. Cl. ..... 108/150; 108/157; 248/174

[58] Field of Search ..... 5/DIG. 1; 248/174, 150; 108/150, 51.3, 153, 157, 159; 211/149; 312/258, 259; 297/440, 442; 229/41 C

[56] References Cited

U.S. PATENT DOCUMENTS

| | | | |
|---|---|---|---|
| 2,361,875 | 10/1944 | Sachs | 5/DIG. 1 |
| 2,707,586 | 5/1955 | Buttery | 229/41 C X |
| 2,744,713 | 5/1956 | De Villers | 108/51.3 X |
| 2,925,213 | 2/1960 | Zukoski | 229/41 C |
| 2,951,669 | 9/1960 | Davidson | 108/51.3 |
| 3,566,808 | 3/1971 | Slate, Jr. et al. | 108/153 X |
| 3,620,175 | 11/1971 | Crane et al. | 108/153 |
| 3,724,399 | 4/1973 | Notko et al. | 108/150 X |
| 3,871,726 | 3/1975 | Stegner | 5/DIG. 1 |

*Primary Examiner*—Roy D. Frazier
*Assistant Examiner*—William E. Lyddane
*Attorney, Agent, or Firm*—Fay & Sharpe

[57] ABSTRACT

Furniture construction which preferably comprises a table which includes an elongated hollow base member having a longitudinal axis and a top peripheral edge. A flat top member has outer and under surfaces, and the under surface is supported on the top peripheral edge of the base member. The top member has a plurality of circumferentially-spaced pockets therein intermediate the outer and under surfaces extending generally perpendicular to the longitudinal axis. A plurality of circumferentially-spaced slots in the under surface of the top member define pocket entrance openings for the pockets. A plurality of spaced-apart deformable tabs extending outwardly from the top peripheral edge of the base member extend through the slots into the pockets for securing together the top and base members.

10 Claims, 11 Drawing Figures

FURNITURE CONSTRUCTION

BACKGROUND OF THE INVENTION

This application pertains to the art of supports and, more particularly, to supports of the type which are sold in a knocked-down condition for assembly by a purchaser. The invention is especially applicable to tables or the like and will be described with particular reference thereof. However, it will be recognized that the invention has broader applications and may be used for displays or supports other than tables as well as other types of furniture constructions.

Inexpensive supports such as tables have been manufactured from cardboard or the like. When such supports are completely assembled at a factory, they occupy a large amount of space during shipment and storage.

In supports which can be assembled by a purchaser, it is desirable that no separate fasteners or adhesive be required. Previous supports which are capable of assembly without the use of additional fasteners or adhesive have not been sturdy and assembly is still relatively complicated.

It would be desirable to have a support which could easily be assembled by a purchaser without requiring the use of additional fasteners or adhesive, while providing a sturdy assembled support having strong locked connections which do not easily come apart.

BRIEF DESCRIPTION OF THE INVENTION

An inexpensive support such as a table or the like is easily assembled by a purchaser without requiring the use of additional fasteners or adhesive. The support includes an elongated hollow base member having a longitudinal axis and a top peripheral edge. A substantially flat top member has outer and under surfaces, and a plurality of circumferentially-spaced pockets are formed therein intermediate the outer and under surfaces extending generally perpendicular to the longitudinal axis. Relatively narrow slots in the under surface of the top member define pocket entrance openings to the pockets. The under surface of the top member rests on the top peripheral edge of the base member, and the base member has a plurality of spaced-apart deformable tabs extending through the slots into the pockets for securing together the top and base members.

The base member may take many forms, and may have a cross-sectional shape which is generally cylindrical or polygonal. The base member is formed from a generally rectangular blank of deformable but relatively rigid material having opposite side edges. The blank is formed into a hollow configuration and its opposite side edges are secured together by suitable fastening means such as integral tabs and slits, adhesive or staples.

In one arrangement, integral spaced-apart deformable tabs extend outwardly from the top edge of the blank. The tabs are deformable about bend lines located below the top edge, and about second bend lines located adjacent the top edge. The tabs are deformable to deformed positions extending generally perpendicular to the longitudinal axis of the base member. In a preferred arrangement, the second bend lines for the tabs are spaced outwardly from the top edge a distance substantially equal to the distance from the under surface to the pockets so that the second bend lines are inside the slots or pocket entrance openings, and the tabs are held in their connecting positions. Pairs of spaced-apart slits extend from the first bend lines for the tabs to the top edge on opposite sides of the tabs.

The top member may take many forms, and may have a generally circular or polygonal peripheral shape. The top member is preferably a multi-layer assembly formed from at least a pair of secured together layers, and the tab receiving pockets are formed between the layers.

In one arrangement, the top member is formed from at least three layers defined by outer, intermediate and under layers. The intermediate layer has a plurality of circumferentially-spaced holes or recesses therein convered by the outer and under layers to define the tab receiving pockets. The under layer has slots therein aligned with the holes or recesses to define the pocket entrance openings. The pockets preferably extend toward the longitudinal axis of the base member from the pocket entrance openings so that the tabs can be pushed into the pockets from outside of the base member instead of from inside thereof.

The top member having at least three layers may have an outer layer which includes generally trapezoidal flaps extending outwardly therefrom. The flaps are bent around the outer periphery of the top member and secured to the underside of the intermediate layer to define the under layer. In such an arrangement, the under layer does not extend across the entire under surface of the top member.

In another arrangement, the top member may be formed from a pair of layers, including upper and under layers, with the under layer having an outer periphery spaced inwardly from the outer periphery of the upper layer. The under layer is adhesively secured to the upper layer, and a plurality of spaced-apart unsecured areas adjacent the outer periphery of the under layer define the tab receiving pockets. The peripheral edge of the under layer along the pockets may be turned downwardly away from the upper layer for ease of inserting the tabs into the pockets.

Many different materials may be used for the support of the present invention. One preferred material is a material commonly referred to as cardboard or corrugated board. Material of this type has opposite plane outer paper layers adhesively bonded to one or more intermediate corrugated paper layers. However, it will be recognized that other deformable yet somewhat rigid materials can be used. For example, it is possible to use materials in the nature of pressed fiberboard, plastics or the like. In addition, a plurality of different materials may be combined in one table, particularly in the top member. The layers of the top member may be formed from wood, plastic, pressed fiberboard, cardboard or hardboard, and combinations of such materials, or any other suitable materials.

It is a principal object of the invention to provide an inexpensive support such as a table or the like which is easily assembled without the use of separate fasteners or adhesive.

It is a further object of the invention to provide such a support which has deformable tabs on a base member receivable in pockets on a top member.

It is another object of the invention to provide an improved base member having integral deformable tabs for cooperation with tab receiving pockets on a top member.

It is an additional object of the invention to provide an improved top member having integral tab receiving pockets formed therein for receiving deformable tabs on a base member.

It is also an object of the invention to provide an improved support such as a table or the like which is very sturdy and capable of carrying relatively heavy loads.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DESCRIPTION OF PREFERRED EMBODIMENTS

Figure 1:
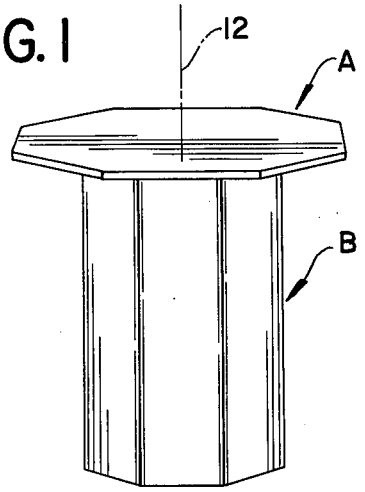
FIG. 1 is a perspective illustration of one form of table constructed in accordance with the present invention.

Referring now to the drawings wherein the showings are for purposes of illustrating preferred embodiments of the invention only and not for purposes of limiting same, FIG. 1 shows a table which includes a flat top member A supported on a base member B.

The table has a longitudinal axis 12 which coincides with the center of top member A and base member B. Base member B is a circumferentially continuous hollow elongated member having a cross-sectional size substantially smaller than the peripheral size of top member A so that the outer portion of top member A extends outwardly beyond base member B. The outer surfaces of the materials used for top member A and base member B may have a decorative appearance such as wood grain or the like. In the arrangement shown in FIG. 1, top member A is polygonal as is base member B. However, it will be recognized that either top member A or base member B, or both, may be circular or cylindrical. Obviously, any desirable shape may be used. In the specific arrangement shown, both top member A and base member B are octagonal.

Figure 2:
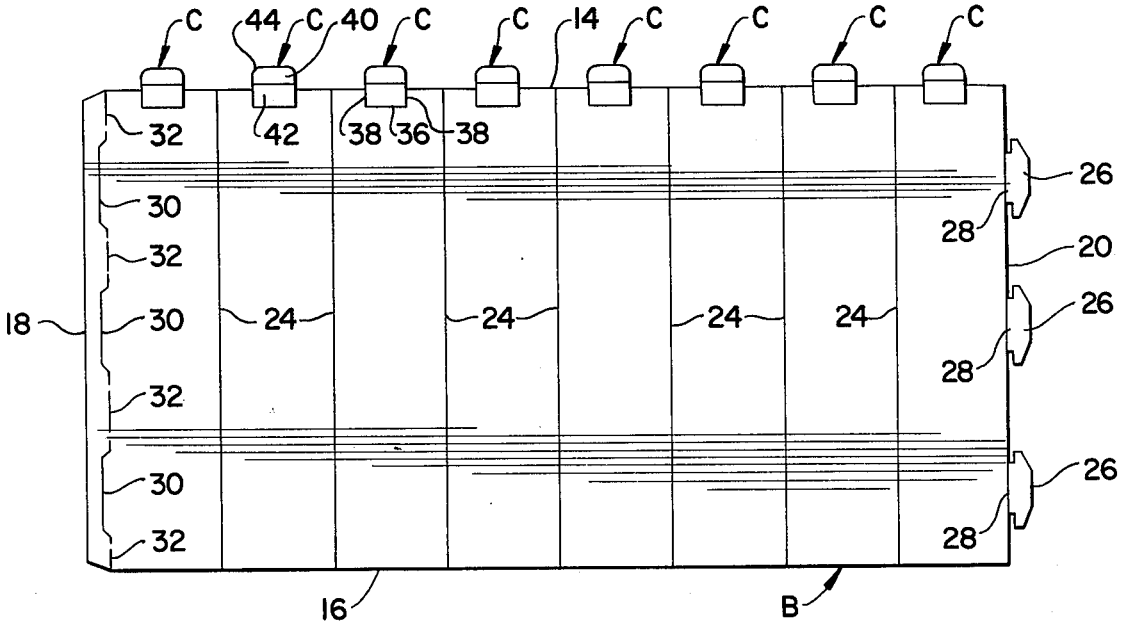
FIG. 2 is a plan view of a generally rectangular blank which is bent into a hollow configuration to form a base member.

FIG. 2 shows a rectangular blank of cardboard having top and bottom edges 14 and 16, and opposite side edges 18 and 20. A plurality of spaced-apart score lines or grooves 24 are formed in the blank between top and bottom edges 14 and 16, parallel to opposite side edges 18 and 20. Score lines 24 define weakening or bend lines for bending the blank into the octagonal shape. A plurality of integral spaced-apart tubs 26 extend outwardly from side edge 20. Bend lines are formed as at 28 along the intersection of tabs 26 with side edge 20 for easy bending of tabs 26 out of the plane of the blank. Tabs 26 have relatively narrow portions where they connect with side edge 20, and enlarged outer end portions. Spaced somewhat inwardly from side edge 18 are a plurality of slits 30 aligned with tabs 26. Slits 30 are of somewhat irregular shape and have straight vertical end portions, and intermediate portions generally in the shape of an equilateral trapezoid. A score line in the blank as at 32 extends between top and bottom edges 14 and 16, and intersects slits 30 for easy bending of the end portion of the blank adjacent side edge 18 to facilitate insertion of tabs 26 into slits 30 for locking opposite side edges 18 and 20 together to form an elongated hollow base member. Once tabs 26 are fully inserted into slits 30, the rear edges of the enlarged portions of tabs 26 engage against the straight portions of the slits for locking the tabs in the slits.

A plurality of integral spaced-apart tabs C extend outwardly from top edge 14. Each tab C has a score line defining a first bend line 36 spaced downwardly from top edge 14 for bending movement of tabs C toward and away from longitudinal axis 12 of FIG. 1. Pairs of spaced-apart slits 38 are formed through the blank and extend from first bend lines 36 to top edge 14 on opposite sides of each tab C. Each tab C includes a second score line defining a second bend line 40 spaced from first bend line 36 and located adjacent top edge 14. In a preferred arrangement, second bend lines 40 are located slightly outwardly from top edge 14. First portions 42 of each tab C are defined between first and second bend lines 36 and 40, and second portions 44 of each tab C are defined between second bend lines 40 and the outer tab edges. Tab portions 44 define deformed portions which are deformable about second bend lines 40 to deformed positions extending generally perpendicular to longitudinal axis 12. Obviously, any number of tabs C may be provided. In the arrangement shown, one tab C is located centrally between each adjacent pair of bend lines 24 in the blank used to form base member B.

Figure 3:
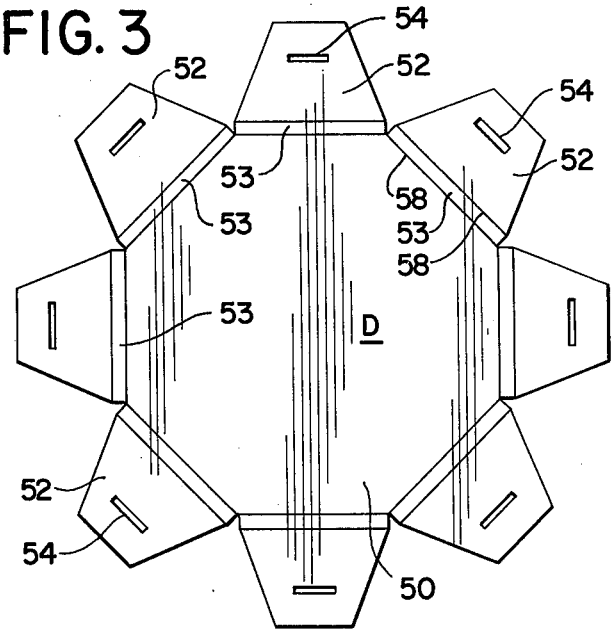
FIG. 3 is a plan view of the underside of a blank used to form both outer and under layers of a flat top member.

FIG. 3 shows a flat cardboard blank D having a polygonal central portion 50 in the shape of an octagon and including a plurality of integral generally trapezoidal flaps 52 extending outwardly therefrom. Generally trapezoidal flaps 52 have small rectangular portions 53 adjacent central portion 50 of blank D, and are trapezoidal outwardly of rectangular portions 53. Each flap 52 has a relatively narrow slot 54 formed therethrough.

Figure 4:
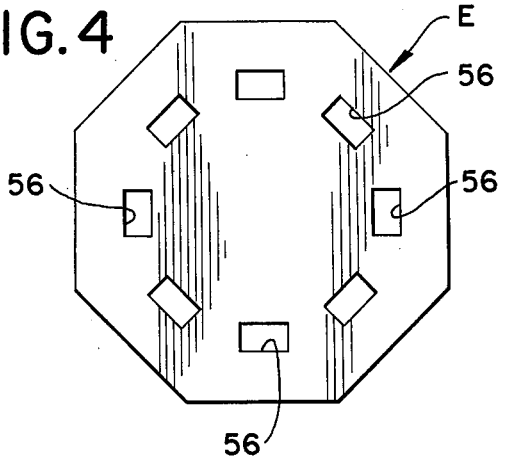
FIG. 4 is a plan view of an intermediate layer used with the blank of FIG. 3.

FIG. 4 shows a cardboard blank which corresponds in size and shape to central portion 50 of blank D. A plurality of generally rectangular holes 56 are formed through blank E in circumferentially spaced-apart relationship to one another inwardly of the outer periphery of blank E.

Figure 5:
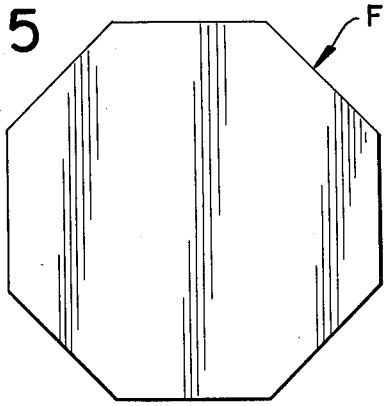
FIG. 5 is a plan view of another intermediate layer blank used with the blanks of FIGS. 3 and 4.
Figure 6:
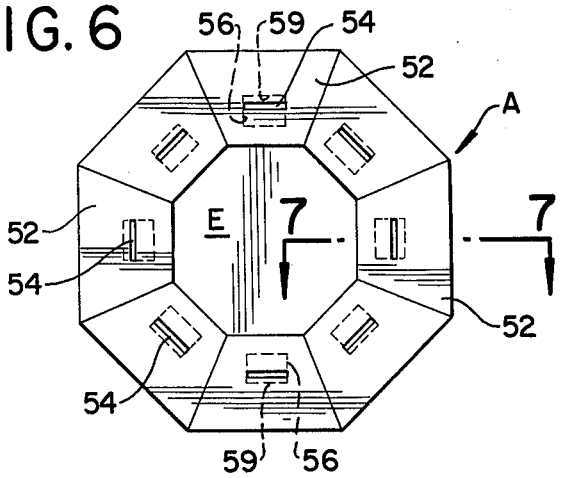
FIG. 6 is a plan view of the underside of a top member assembled from the blanks of FIGS. 3, 4 and 5.
Figure 7:
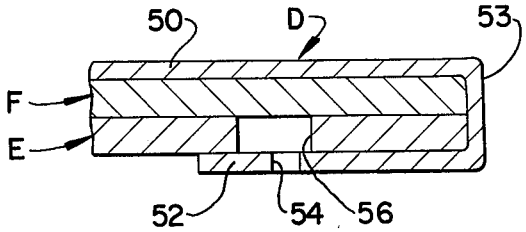
FIG. 7 is a partial cross-sectional view taken generally on line 7—7 of FIG. 6.

FIG. 5 shows a cardboard blank F having the same size and shape as blank E of FIG. 4. Blank E is secured to blank F as by use of adhesive, or in any other suitable manner, and the two blanks are positioned on central portion 50 of blank D, with blank F engaging the undersurface of central portion 50. Adhesive may be used for securing the three blanks together. Flaps 52 on blank D are then bent over the outer periphery of blanks E and F, and are then bent inwardly in overlying relationship to blank E as shown in FIG. 6. Each flap 52 has score lines defining bend lines as at 58 for ease of bending thereof. Flaps 52 are secured to blank E by the use of adhesive or staples, or other suitable fasteners. Flaps 52 overlie holes 56 in blank E so that holes 56 define pockets extending generally perpendicular to axis 12. Holes 56 may be considered recesses in the intermediate layer of the multi-layer top member. Slots 54 in flaps 52 are aligned with tab receiving pockets 56 to define pocket entrance openings. Pockets 56 preferably extend toward the center or longitudinal axis of top member A from pocket entrance openings 54. Pocket entrance openings 54 are preferably located slightly inwardly from the outer edges 59 of tab receiving pockets 56 so that the cardboard material in the flaps 52 may deform somewhat between pocket outer edges 59 and the beginning of slots 54 to aid in inserting tabs C into pockets 56 through slots 54.

Figure 8:
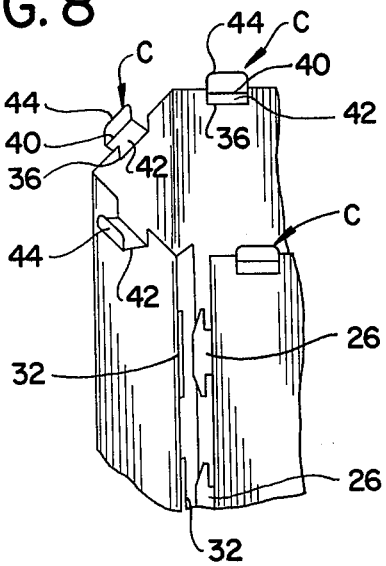
FIG. 8 is a partial perspective illustration showing the blank of FIG. 2 formed into a hollow configuration and tabs bent to positions ready for assembly of the base member with the top member of FIG. 6.
Figure 9:
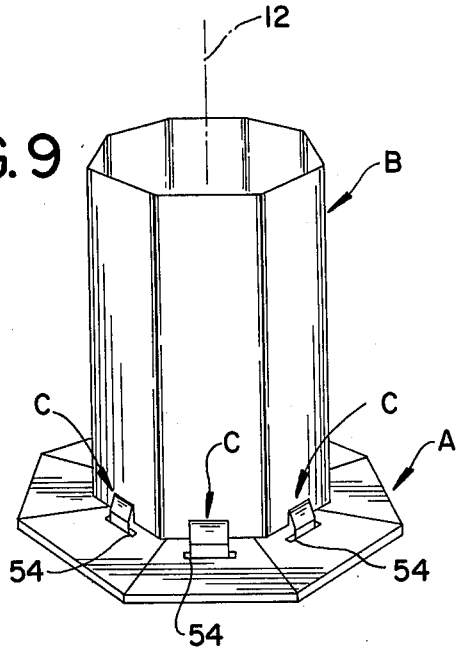
FIG. 9 is an inverted perspective illustration showing the base member being assembled to the top member to form the table of FIG. 1.

The blank of FIG. 2 is formed into a generally polygonal shape as shown in FIG. 8, and side tabs 26 are inserted through the slits 30 for locking the blank in its elongated hollow form. Tabs C are also bent about bend lines 36 outwardly away from the longitudinal axis of base member B, while deformed tab portions 44 are bent about bend lines 40 to positions extending generally perpendicular to tab portions 42. With the base member so assembled and the tabs bent as described, top member A is placed on a supporting surface with its underside facing upwardly as shown in FIG. 9. Base member B is inverted with tabs C generally aligned with pocket entrance openings 54. Each tab C then has a pushing force applied to first portion 42 thereof for moving same to a position generally parallel to longitudinal axis 12, while deformed tab portions 44 are extended through pocket entrance openings 54 for reception in pockets 56 of FIG. 6. Each individual tab C is moved into its locked position as described. Location of second bend lines 40 on tabs C outwardly of top peripheral edge 14 in FIG. 2 allows the outer portions of first tab portions 42 to extend into slots 54 so that first tab portions 42 are locked in their generally vertical positions parallel to axis 12 once they are pushed into slots 54. The distance from top edge 14 to the outer surfaces of deformed portions 44 may be generally the same as the predetermined distance from the outer surface of flaps 52 to the bottom of tab receiving pockets 56.

In one arrangement, blank D has a thickness which is approximately one-half the thickness of blanks E and F. Therefore, tabs C are easily insertable into pockets 56 because such pockets have a depth greater than the thickness of tab deformed portions 44. The distance between top edge 14 and a second bend line 40 may be approximately equal to the thickness of flaps 52, or substantially equal to the distance from the outer surface of flaps 52 to pockets 56. This arrangement securely locks tabs C in position against displacement of such tabs from their connecting positions. In the locked positions of tabs C, deformed portions 44 extend generally perpendicular to longitudinal axis 12, although such deformed portions may be at a small angle to a plane perpendicular to axis 12.

Figure 10:
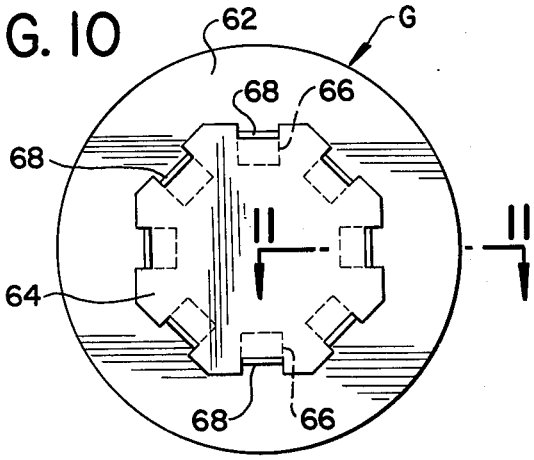
FIG. 10 is a plan view of the underside of another top member.
Figure 11:
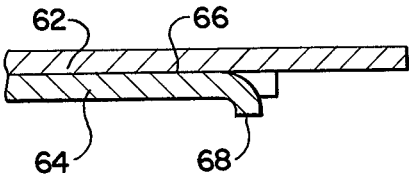
FIG. 11 is a cross-sectional elevational view taken generally on line 11—11 of FIG. 10.

In the embodiment of FIGS. 10 and 11, a flat table top G has a generally circular hardboard layer 62 and a cardboard under layer 64 adhesively bonded to the under surface thereof. This embodiment is particularly advantageous in allowing the successful provision of a hard or fiberboard outer layer 62 which has heretofore been unobtainable when using the prior art structures. While outer layer 62 has been particularly shown as being circular, it will be readily appreciated that polygonal configurations may also be advantageously employed. Under layer 64 has a peripheral size substantially smaller than the peripheral size of outer layer 62. A plurality of circumferentially-spaced areas 66 adjacent the outer periphery of under layer 64 are not bonded to the under surface of outer layer 62 so that tab receiving pockets are formed. Very short slits are formed through under layer 64 at the outer periphery thereof on opposite sides of unbonded areas 66 defining the pockets and the material is turned downwardly as at 68 away from outer layer 62. This provides a pocket entrance opening so that the outer edges of tabs C can be forced into the unbonded areas defining pockets 66. Cardboard under layer 64 has sufficient give to allow deformed portions 44 of tabs C to be forced into the pockets 66.

In the arrangements shown and described, the top member is multi-layered to include outer, intermediate and under layers. The tab receiving pockets are formed in the top member intermediate the outer and under layers. In the embodiment of FIGS. 3–6, the tab receiving pockets are formed in the intermediate layer. In the embodiment of FIGS. 10 and 11, the tab receiving pockets are formed between a pair of layers. The tab receiving pockets are formed intermediate opposite facing outer and under surfaces. The under surface of the top member rests firmly on the top peripheral edge of the base member. Flaps 52 and under layer 64 of FIG. 10 may also be considered an inner layer for the top member.

In the embodiment of FIG. 10, the distance from top edge 14 to the outer surface of tab portions 44 in their deformed positions may be generally the same as the distance from the outer surface of under layer 64 to the under surface of outer layer 62. The distance from top edge 14 to the outer surfaces of tab portions 44 in their deformed positions may be slightly greater than the distance from the outer surface of layer 64 to the under surface of outer layer 62 so that tabs C will frictionally engage the under surface of outer layer 62 for holding tabs C in position. As used with the top G of the FIGS. 10 and 11 embodiment, second bends 40 on tabs C of the base could also be substantially coextensive with top edge 14. In the embodiment of FIGS. 10 and 11, the pockets tightly squeeze on tab portions 44 to aid in holding tabs C against displacement.

In one arrangement, the table shown and described has been assembled using 200 pound test corrugated board. A tablecloth may be draped over the table if so desired to give it an attractive appearance. Although the table is not recommend for extremely high loads, a 200 pound person has sat on the table with no visible signs of damage.

Locating the tabs and tab receiving pockets so that the tabs can be pushed into the pockets from outside the base member makes assembly much easier than an arrangement where it would be necessary to reach inside base member B to push the tabs outwardly. Such reaching is made extremely difficult and virtually impossible when the axial length of base member B is greater than the arm length of the person who is assembling the structure.

Again, top member A and base member B may take many varied and different forms for constructing different types of supports and furniture. Furthmore, the material employed in such constructions may also be readily varied and almost any deformable yet rigid material can be used. Such materials can include, and by way of example only, cardboard, fiberboard, plastic or the like.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

Having thus described my invention, I now claim:

1. A table top or the like comprising: a generally flat member having outer and under surfaces and a central axis extending substantially perpendicular to said outer and under surfaces, a plurality of spaced-apart tab receiving pockets in said member intermediate said outer and under surfaces extending generally perpendicular to said axis, narrow pocket entrance openings to said pockets, said pockets extending toward said axis from said entrance openings, said flat member including flat outer and under layers directly secured together and having outer peripheries, said outer periphery of said under layer being spaced inwardly from said outer periphery of said outer layer, and said under layer being unsecured to said outer layer in unsecured areas at a plurality of spaced-apart locations adjacent said outer periphery thereof to define said pockets directly between said outer and under layers and allow entry of said tabs between said outer and under layers in said unsecured areas, and said entrance openings being directly at the outer periphery of said under layer.

2. The top of claim 1 wherein said outer periphery of said under layer is bent away from said outer layer along said pockets.

3. The table top or the like of claim 1 wherein said under layer includes pairs of slits on opposite sides of said unsecured areas extending inwardly a small distance from the outer periphery of said under layer for deformation of said under layer away from said outer layer between each said pair of slits to define said pocket entrance openings.

4. The table top or the like of claim 1 wherein said under layer is polygonal and includes a plurality of straight sides intersecting at corners, said unsecured areas being located along said straight sides centrally between adjacent ones of said corners.

5. The table top or the like of claim 1 including a hollow base member having a top peripheral edge supporting said generally flat member, a plurality of spaced-apart integral deformable tabs extending from said top peripheral edge, said tabs extending through said pocket entrance opengings and being received in said pockets.

6. A support or the like comprising: a hollow base member having a central longitudinal axis and a top peripheral edge, a plurality of circumferentially-spaced deformable tabs on said base member normally extending upwardly of said top peripheral edge and being deformable to deformed positions extending generally perpendicular to said axis, a top member including an outer layer having an outer peripheral portion deformed downwardly and inwardly in substantially parallel underlying spaced relationship to said outer layer to define an under layer, a plurality of circumferentially-spaced downwardly facing openings in said under layer, said under layer being supported on said top peripheral edge of said hollow base member, tab receiving spaces intermediate said outer and under layers extending toward said axis from said openings, and said tabs being in said deformed positions and extending through said openings and being received in said spaces for securing together said base and top members.

7. The support of claim 6 wherein said tabs are deformable to said deformed positions about bend lines located closely adjacent said top peripheral edge of said base member.

8. The support of claim 7 wherein said bend lines are located outwardly of said top peripheral edge and those portions of said tabs between said top peripheral edge and said bend lines are received in said openings to lock said tabs therein.

9. A support or the like comprising: a hollow base member having a central longitudinal axis and a top peripheral edge, a plurality of circumferentially-spaced deformable tabs on said base member normally extending upwardly of said top peripheral edge and being deformable to deformed positions extending generally perpendicular to said axis, a generally polygonal top member having an outer periphery and including at least three layers secured together and defined by an outer layer, an intermediate layer and an inner layer, said intermediate layer having a plurality of circumferentially-spaced enlarged holes therethrough inwardly of said outer periphery, said outer and inner layers being integral and spanning said holes to define tab receiving pockets extending generally perpendicular to said axis, said outer layer having a plurality of generally trapezoidal flaps deformed around said outer periphery of said top member and secured to said intermediate layer in overlying relationship thereto to define said inner layer, said inner layer having slots therethrough aligned with said holes to define entrance openings to said pockets, said inner layer having an outer surface defining an under surface of said top member, said top member having said under surface thereof supported on said top peripheral edge, said tabs being in said deformed positions and extending through said entrance openings into said pockets for securing together said base and top member.

10. The support of claim 9 wherein said tabs are deformable to said deformed positions about bend lines spaced outwardly from said top peripheral edge.

* * * * *